US009194092B2

(12) United States Patent
Kline

(10) Patent No.: US 9,194,092 B2
(45) Date of Patent: Nov. 24, 2015

(54) MECHANISM FOR AUTOMATED MIXING OF LIQUID SOLUTIONS AND GRANULAR MATERIALS

(76) Inventor: Mark Kline, Lonsdale, MN (US)

( * ) Notice: Subject to any disclaimer, the term of this patent is extended or adjusted under 35 U.S.C. 154(b) by 146 days.

(21) Appl. No.: 13/010,488

(22) Filed: Jan. 20, 2011

(65) Prior Publication Data

US 2011/0180637 A1 Jul. 28, 2011

Related U.S. Application Data

(60) Provisional application No. 61/298,376, filed on Jan. 26, 2010.

(51) Int. Cl.

| | |
|---|---|
| ***B01F 7/08*** | (2006.01) |
| ***B01F 15/02*** | (2006.01) |
| ***B01F 3/12*** | (2006.01) |
| ***E01H 10/00*** | (2006.01) |
| ***B01F 7/02*** | (2006.01) |
| ***B01F 13/00*** | (2006.01) |

(52) U.S. Cl.

CPC ..... *E01H 10/007* (2013.01); *B01F 3/1221* (2013.01); *B01F 7/024* (2013.01); *B01F 7/08* (2013.01); *B01F 7/081* (2013.01); *B01F 13/0035* (2013.01); *B01F 15/027* (2013.01); *B01F 15/0289* (2013.01); *B01F 7/083* (2013.01)

(58) Field of Classification Search

CPC ..... B10F 3/12; B10F 3/1221; B10F 3/1228; B01F 5/04; B01F 5/0401; B01F 5/045; B01F 5/0453; B01F 5/0455; B01F 5/0456; B01F 5/0461; B01F 5/0468; B01F 7/00008; B01F 7/00016; B01F 7/02; B01F 7/022; B01F 7/024; B01F 13/0016; B01F 13/0018; B01F 13/0037; B01F 2003/12; B01F 2005/04; B01F 2005/0403; B01F 13/0035; B01F 15/027; B01F 15/0289; B01F 3/1221; B01F 7/08; B01F 7/081

USPC ..... 366/169.1, 170.2, 307, 186, 169.2, 195

See application file for complete search history.

(56) References Cited

U.S. PATENT DOCUMENTS

| | | | | | |
|---|---|---|---|---|---|
| 485,986 | A | * | 11/1892 | Saladin | 366/102 |
| 1,763,122 | A | * | 6/1930 | Bailey | 366/102 |
| 3,226,205 | A | * | 12/1965 | Rohlfing | 422/134 |
| 3,482,520 | A | * | 12/1969 | Larsen | 415/115 |
| 3,495,813 | A | * | 2/1970 | Marenghi et al. | 266/202 |
| 3,500,901 | A | * | 3/1970 | Mery et al. | 165/86 |
| 4,022,386 | A | | 5/1977 | Caye | |
| 4,234,109 | A | | 11/1980 | Goodhart | |
| 4,329,063 | A | * | 5/1982 | Edwards | 366/34 |

(Continued)

FOREIGN PATENT DOCUMENTS

EP 0334013 B2 11/1995

*Primary Examiner* — Tony G Soohoo

(74) *Attorney, Agent, or Firm* — Craig J. Lervick; Larkin Hoffman Daly & Lindgren, Ltd.

(57) ABSTRACT

Disclosed is a mixing mechanism. The mixing mechanism includes an auger, a fluid handling portion, and at least one discharge hole. The auger configured to receive granular materials from a granular material source and capable of moving the granular material along a predetermined path. The fluid handling portion is coupled to a fluid supply source and has an inlet within an interior section of the auger. The size and positioning of the discharge hole (or holes) along the auger are specifically configured to allow for optimum mixing of the materials prior to being discharged.

9 Claims, 5 Drawing Sheets

(56) References Cited

U.S. PATENT DOCUMENTS

| | | | | | |
|---|---|---|---|---|---|
| 4,390,286 | A | * | 6/1983 | Regaldo | 366/186 |
| 4,427,489 | A | * | 1/1984 | Jacobsen | 162/57 |
| 4,442,979 | A | | 4/1984 | Kupper | |
| 4,448,685 | A | * | 5/1984 | Malina | 210/219 |
| 4,551,024 | A | * | 11/1985 | Clapp | 366/40 |
| 5,018,673 | A | * | 5/1991 | Eirich et al. | 241/62 |
| 5,069,392 | A | | 12/1991 | Wise et al. | |
| 5,096,125 | A | | 3/1992 | Wise et al. | |
| 5,186,396 | A | | 2/1993 | Wise et al. | |
| 5,352,035 | A | * | 10/1994 | Macaulay et al. | 366/15 |
| 5,513,911 | A | * | 5/1996 | Schwing | 366/40 |
| 5,718,508 | A | * | 2/1998 | Williams | 366/138 |
| 5,887,972 | A | * | 3/1999 | Dickmeiss et al. | 366/76.1 |
| 5,931,393 | A | | 8/1999 | Alsip et al. | |
| 6,361,266 | B1 | | 3/2002 | Hagemeyer et al. | |
| 6,382,535 | B1 | | 5/2002 | Kime | |
| 6,644,847 | B2 | * | 11/2003 | Boos | 366/138 |
| 6,727,090 | B1 | * | 4/2004 | Hronek | 435/290.4 |
| 2011/0180637 | A1 | * | 7/2011 | Kline | 239/670 |

* cited by examiner

MECHANISM FOR AUTOMATED MIXING OF LIQUID SOLUTIONS AND GRANULAR MATERIALS

RELATED APPLICATIONS

This application is related to and claims the benefit of previously filed U.S. Provisional Application 61/298,376, filed Jan. 26, 2010 and entitled "Mechanism for Automated Mixing of Liquid Solutions and Granular Materials".

FIELD OF INVENTION

The present invention relates to a mechanism for the controlled mixing of a liquid with a granular material, prior to the mixture being discharged. More specifically, one embodiment of the invention involves an auger mechanism for mixing a granular material, such as a salt and sand mixture, with a brine liquid immediately prior to ejection upon a roadway.

BACKGROUND OF THE INVENTION

In colder climates, the removal of snow and ice from roadways is often a challenging task. The failure to effectively remove snow and ice creates very hazardous driving conditions, which can ultimately result in accidents and fatalities. Even when a majority of the snow has been removed, any remaining snow or ice creates a hazard. To address this challenge, snowplows are typically equipped with sanding equipment.

Consequently, these snowplows have the ability to remove as much snow as possible, and to apply sand, salt or a sand/salt combination to the roadway. Sand alone with help to provide traction, while the application of salt or a salt mixture will promote melting of ice and snow.

Salting and sanding mechanisms have existed for years and typically include a spreader mechanism for distributing sand (and/or salt). Typical spreaders involve a rotational disk which is spun in a desired directed of rotation. Sand or sand salt mixture is then delivered to this spinning disk, which will cast the mixture over a desired area. These delivery mechanisms are typically attached to the rear portion of the sanding truck and will cause the granular material to be spread behind the plowing truck as it progresses along the roadway.

BRIEF SUMMARY OF THE INVENTION

The embodiments of the invention primarily include a mixing mechanism. The mixing mechanism includes an auger, a fluid handling portion, and a plurality of discharge hole. The auger is configured to receive granular materials from a granular material source and capable of moving the granular material along a predetermined path. The fluid handling portion is coupled to a fluid supply source and has an inlet within an interior section of the auger. The discharge holes are located at predetermined locations along the auger.

The positioning and orientation of the various components creates a system which effectively and efficiently mixes the various liquids and granular material.

BRIEF DESCRIPTION OF THE SEVERAL VIEWS OF THE DRAWINGS

Non-limiting and non-exhaustive embodiments are described with reference to the following figures.

DETAILED DESCRIPTION OF THE INVENTION

Figure 1:
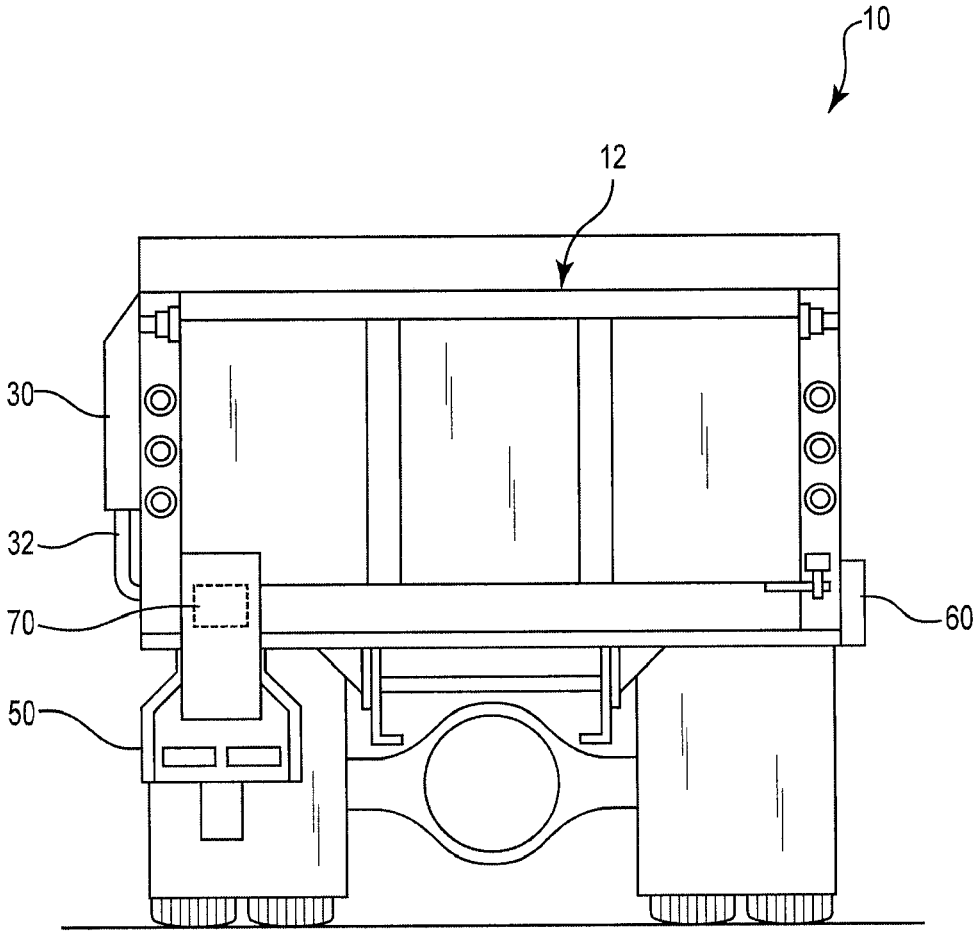
FIG. 1 illustrates a rear portion of a sanding truck.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

Generally, a mixing mechanism for combining a liquid and a granular material, and delivering the mixture to a desire location at a desired rate is disclosed. The mixing mechanism may include a fluid supply source, a granular material source, and an auger. The auger is configured to receive the granular material from the granular material source and move the granular material along a predetermined path. The auger may have a fluid handling portion that provides fluid to an interior section of the auger. The fluid handling portion is configured to receive the liquid from the fluid supply source. The auger also includes at least one discharge hole located at a predetermined location along the auger. The discharge hole is in fluid communication with the interior section of the auger. The discharge hole may be located a distance equal to approximately one-third of the auger's length from one end of the auger. Similarly, a number of discharge holes could be spaced around the circumference of the auger at a position approximately one-third the length of the auger.

The mixing mechanism may also include a drive mechanism connected to the auger. The drive mechanism may be powered by the hydraulic or pneumatic system of a vehicle. Also, the drive mechanism may have a power source that is independent of the vehicle's operational systems. In other words, the drive mechanism may be powered by a source that does not require the vehicle to be in operation for the drive mechanism to operate. For instance, the drive mechanism may be powered by an electric motor connected to the vehicle's battery. Thus, the drive mechanism can operate without the vehicle running.

The mixing mechanism may also include a control system operatively connected to the mixing mechanism. Such a control system would be programmed to adjust the desired rate of discharge based on the speed of a vehicle. The control system may also be programmed to adjust the desired rate based on other factors such as the outdoor air temperature, the temperature of the liquid, and the temperature of the granular material, the size of the granular material, etc.

A method for combining a liquid and a granular material in a vehicle and delivering the mixture to a desire location at a desired rate is disclosed. Generally, the method includes: 1) providing an auger located in the vehicle, 2) receiving, at the auger, the granular material from a granular material source, 3) receiving, at an interior portion of the auger, the liquid, 4) dispensing the liquid, via at least one discharge hole, at a predetermined location, 5) rotating, via a drive mechanism and the auger to cause the granular material to move along the predetermined path and mix with the liquid, and 6) delivering the mixture to a dispensing location at the desired rate.

Turning now to the figures, FIG. 1 illustrates a rear portion of a sanding truck 10. In this particular embodiment, a delivery mechanism 50 is attached to the left hand rear portion of truck 10. It is contemplated that the delivery mechanism 50 could alternately be attached to the right hand rear portion of truck 10. In addition, the delivery mechanism 50 may be attached to both the left and right front portions of truck 10 as well. Although not specifically shown in FIG. 1, the mixing mechanism 100 (see FIG. 2) is incorporated behind the rear tailgate of truck 10. In use, a sand and salt mixture may be carried in a bucket 12 of truck 10. It will be recognized that alternative granular materials could be used, such as salt alone, sand alone, gravel, etc. During use, the granular material can be moved to the rear portion of bucket 12 by tilting or tipping in a well known fashion.

As discussed below with respect to FIGS. 2 and 3, an auger mechanism 110 may move the granular material to delivery mechanism 50 as needed. In this embodiment, the discharge point (delivery mechanism 50) is located at the rear left hand side (driver's side) of truck 10. Truck 10 also carries a fluid supply 30. Note that instead of one fluid supply 30, truck 10 may have more than one fluid supply. The fluid may be a brine solution or any other liquid a user may desire to mix with the granular material. It is also contemplated that multiple fluid supplies may be used and each fluid supply may contain a different liquid to allow for mixing of various liquids with the granular material. For instance, one fluid supply may contain a highly concentrated brine solution and a second fluid supply may contain water. During operation, the highly concentrated brine solution may be diluted by mixing it with the water and granular material.

Figure 2:
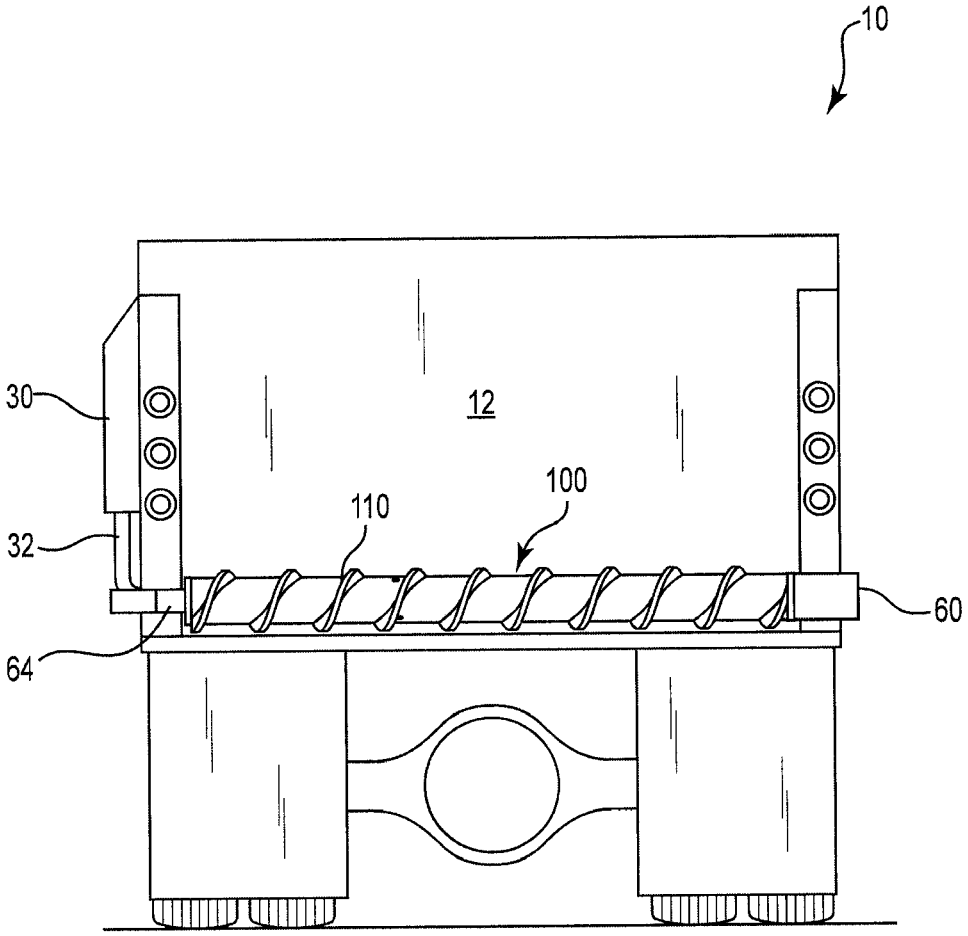
FIG. 2 illustrates the rear portion of the sanding truck in FIG. 1 with the tailgate or rear cover removed.

In FIGS. 1 and 2 the fluid supply 30 is located on an exterior side of bucket 12. However, it should be noted that this configuration is one potential embodiment, and several other variations may exist. For example, fluid supply 30 could be positioned above or below bucket 12, or bucket 12 could be configured to have specific compartments or recesses to carry fluid supply 30. Fluid handling hoses or pipes 32 are configured to deliver liquid to a desired location within mixing mechanism 100. The fluid may be fed from fluid supply 30 via gravity flow or a pump. Further details regarding this delivery and mixing are outlined below.

Also illustrated in FIG. 1 is a drive mechanism 60. Drive mechanism 60 provides rotational power to the auger. Drive mechanism 60 could include different types of systems or components, such as a hydraulic, a pneumatic or an electric motor.

Related actuators or controls 70 are provided to allow an operator to appropriately control the system. While controls 70 are shown located on delivery mechanism 50, it is contemplated that controls 70 could be located in the cab of truck 10. In addition, controls 70 can be programmed to control the speed of auger 110, and thus controlling mixing rates, delivery rates, amount of liquid delivered to the auger, etc. Controls 70 can also be programmed to vary the operation rates depending on many factors such as, the outdoor air temperature, the temperature of the granular material, the temperature of the liquid, the speed of truck 10, estimated snow fall, the road surface material (e.g. asphalt, concrete, dirt, etc.).

For further context, FIG. 2 illustrates truck 10 with the tailgate or rear cover removed, thus exposing mixing mechanism 100. Generally speaking, a granular material is contained within bucket 12 of truck 10. Likewise, a liquid is contained within fluid supply 30 system. As will be better described in relation to FIG. 3 below, the liquid is supplied to an internal portion of auger 110 to accommodate mixing with the granular material. As mentioned above, mixing mechanism 100 is driven by drive mechanism 60 to cause rotation in a desired direction. Additionally, a fluid coupling mechanism 64 exists at one end of auger 110 to supply the fluid while also allowing rotation of auger 110. As will be appreciated by those familiar with moving fluid handling components, appropriate bearings and fluid couplings are utilized to allow simultaneous rotation and fluid flow.

Figure 3:
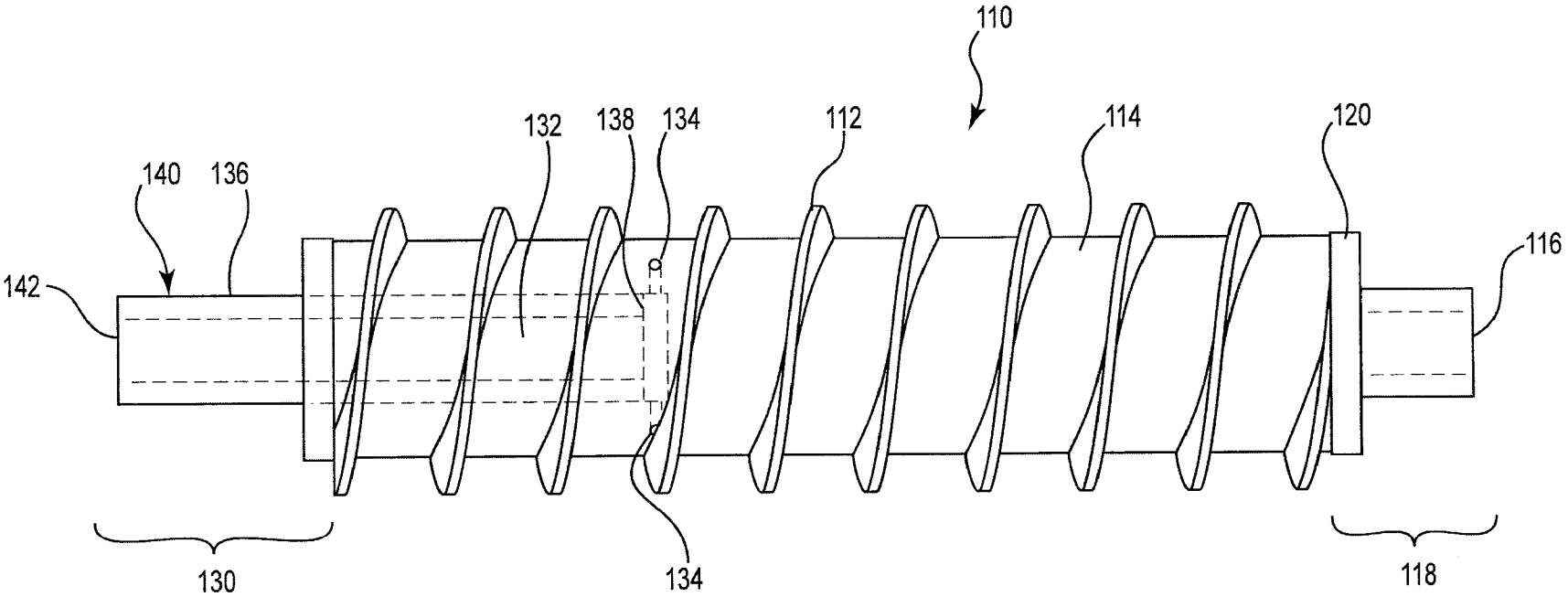
FIG. 3 illustrates an auger.

Referring now to FIG. 3, a more detailed illustration of auger 110 is shown. As discussed above, one function of auger 110 is the movement of the granular mixture in a desired direction. To achieve this, a number of auger blades 112 are appropriately attached to a main shaft 114. As illustrated, an opening 116 is provided at the drive end 118 to accommodate coupling of the auger 110 to drive mechanism 60. This opening could be configured in several different ways as necessary to be coupled with drive mechanism 60. For example, the opening could be configured to receive a drive shaft with a hexagon shaped cross section. Further alternatives are clearly possible. As also illustrated, the opening 116 terminates at a collar portion 120. Adjacent to collar portion 120, shaft 114 could be either a stainless steel tube having sufficient wall thickness, or a solid steel component, thus providing desired strength to perform the augering functions necessary.

At an opposite end or a fluid handling end 130 of auger 110 a specific fluid handling system is provided. More specifically, shaft 114 includes an opening 132 which may be bored or drilled out, extending for a predetermined distance. Further, a number of fluid delivery holes or discharge holes 134 are drilled from an outer surface of shaft 114 to the interior of opening 132. Consequently, discharge openings 134 are in fluid communication with opening 132. A fluid handling pipe 136 is inserted into opening 132 and positioned such that its first end 138 is adjacent to but not covering discharge openings 134. A second end 140 extends outwardly from shaft 114.

In operation, the liquid will be provided to opening 142 in second end 140 of fluid pipe 136. The liquid may then be discharged through discharge or delivery openings 134. The liquid may then be mixed with the granular material at this location, and as it travels to delivery mechanism 50 on truck 10. As illustrated in FIGS. 1 and 2, this will involve mixing over approximately the left hand one-third of mixing mechanism 100 illustrated in FIG. 2. Those skilled in the art will easily recognize that the embodiments illustrated could be modified such that auger 110 is operated in a reverse direction and material is moved from left to right in FIG. 2. Naturally, if the location of discharge holes is not changed, this would change the distance over which the mixing is achieved.

It has been found that the configuration listed above, and mixing of granular sand/salt and the brine solution over only a limited portion of the auger provides the most optimum and efficient combination of brine and sand/salt mixture. Further, the brine handling mechanism keeps the brine solution in desired compartments and areas so as to avoid any possible complications caused by brine solution being spread to undesired locations. Discharge openings 134 are sized and positioned to achieve this optimum mixing condition. Naturally, the size of openings 134 will help to control the amount of liquid that can be dispensed, while the positioning limits the mixing to a specific area.

Figure 4:
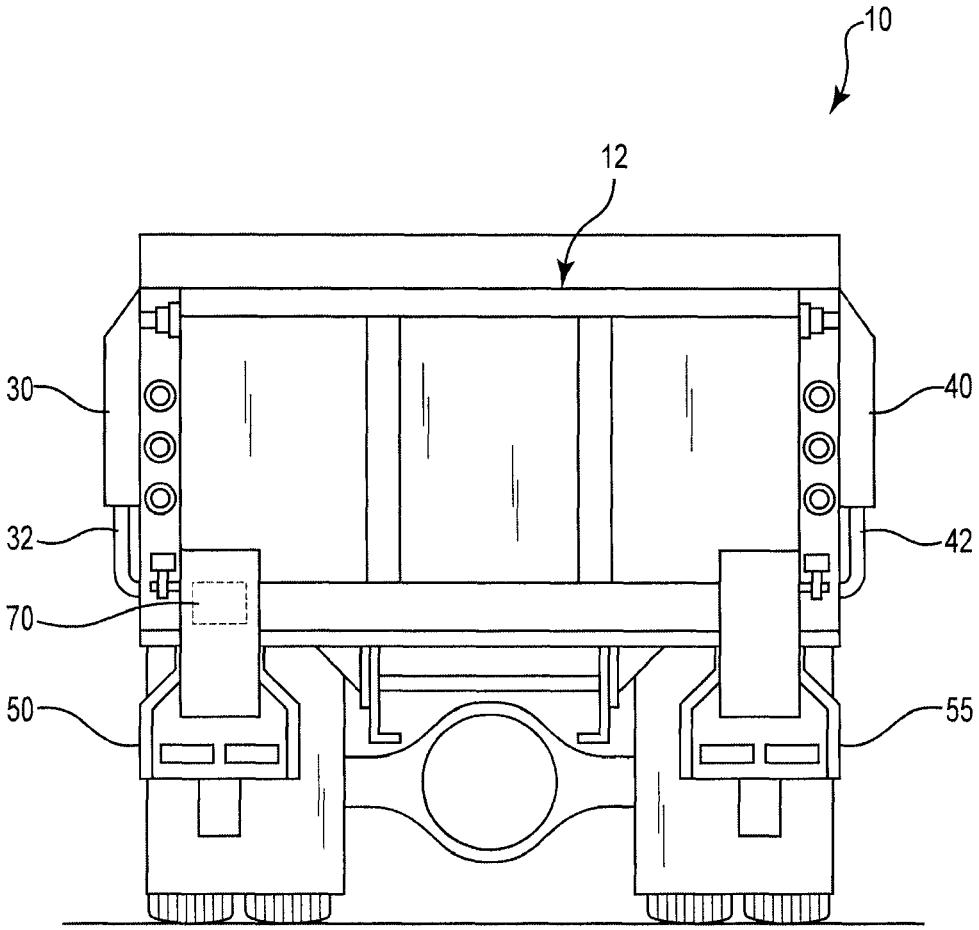
FIG. 4 illustrates a rear portion of a sanding truck.

Turning now to FIG. 4, a rear portion of a sanding truck 10 is illustrated. In this particular embodiment, a first delivery mechanism 50 and a second delivery mechanism 55 are attached to both the left and right hand rear portions of truck 10, respectively. It is contemplated that first and second delivery mechanisms 50 and 55 may be attached to the rear and front portions of the truck 10. Although not specifically shown in FIG. 4, a first mixing mechanisms 100 and a second mixing mechanism 150 (see FIG. 5) are incorporated behind the rear tailgate of the truck 10. In use, a sand and salt mixture may be carried in bucket 12 of truck 10. It will be recognized that alternative granular materials could be used, such as salt alone, sand alone, gravel, etc. During use granular material can again be moved to the rear portion of bucket 12 by tilting or tipping in a well known manner.

As discussed below with respect to FIG. 5 and above with respect to FIG. 3, a first auger 110 and a second auger 112 may move the granular material to first delivery mechanism 50 and second delivery mechanism 55 as needed. In this embodiment, the discharge points (i.e. first and second delivery mechanisms 50 and 55) are located at the rear left and right hand sides of the truck 10. Truck 10 also carries two fluid supplies, a first fluid supply 30 and a second fluid supply 40. Note that instead of first fluid supply 30 and second fluid supply 40, truck 10 may have only one fluid supply or more than two fluid supplies. The fluid may be a brine solution or any other liquid a user may desire to mix with the granular material. It is also contemplated that multiple fluid supplies may be used and each fluid supply may contain a different liquid to allow for mixing of various liquids with the granular material. For instance, one fluid supply may contain a highly concentrated brine solution and a second fluid supply may contain water. During operation, the highly concentrated brine solution may be diluted by mixing it with the water and granular material.

Figure 5:
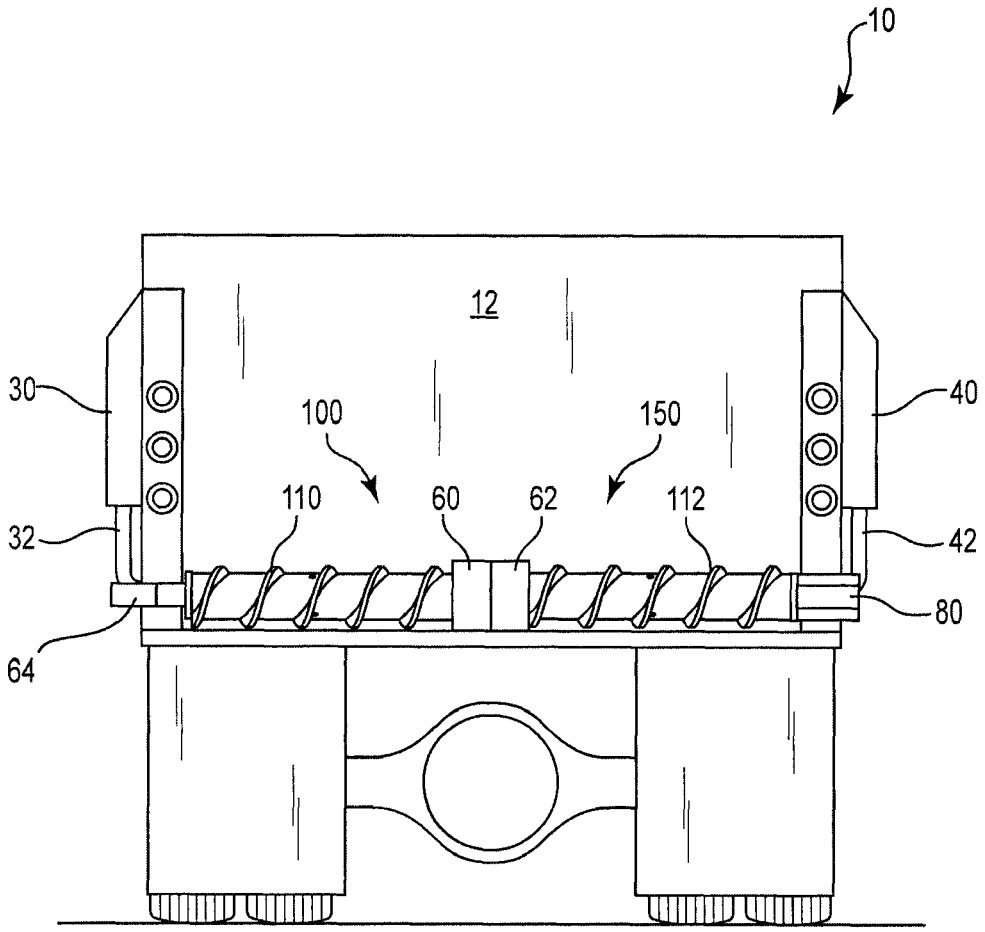
FIG. 5 illustrates the rear portion of the sanding truck in FIG. 4 with the tailgate or rear cover removed.

In FIGS. 4 and 5 first fluid supply 30 and second fluid supply 40 are located on an exterior side of bucket 12. It should be noted that this configuration is only one potential embodiment, and several other variations may exist. For example, first and second fluid supplies 30 and 40 could be positioned above or below bucket 12, or bucket 12 could be configured to have specific compartments or recesses to carry the fluid supplies 30 and 40. First and second fluid handling hoses or pipes 32 and 42 are configured to deliver liquids to a desired location within first mixing mechanism 100 and second mixing mechanism 150. The fluids may be fed from first and second fluid supplies 30 and 40 via gravity flow or a pump. Further details regarding this delivery and mixing are outlined above with respect to FIG. 3.

Also illustrated in FIG. 4 are first and second drive mechanisms 60 and 62. Similar to the systems described above, first drive mechanism 60 and second drive mechanism 62 provide rotational power to first auger 110 and second auger 112. Both first drive mechanism 60 and second drive mechanism 62 may include various components, such as a hydraulic, a pneumatic or an electric motor.

Related actuators or controls 70 are provided to allow an operator to appropriately control the system. While controls 70 are shown located on delivery mechanism 50, it is contemplated that controls 70 could be located in the cab of the truck 10. In addition, while only one set of controls 70 is show, it is contemplated that a separate set of controls could be provided for each first mixing mechanism 100 and second mixing mechanism 150. Furthermore, controls 70 can be programmed to control the speed of first auger 110 and second auger 112, and thus mixing rates, delivery rates, amount of liquid delivered to the auger, etc. Controls 70 can be programmed to vary the assortment of rates depending on many factors such as, the outdoor air temperature, the temperature of the granular material, the temperature of the liquid, the speed of truck 10, estimated snow fall, the road surface material (e.g. asphalt, concrete, dirt, etc.).

When there is more than one mixing mechanism, it is contemplated that a single set of controls may control the assortment of rates independently. For example, first mixing mechanism 100 may deliver the mixture to first delivery mechanism 50 at a faster or slower rate than second mixing mechanism 150 delivers the mixture to second delivery mechanism 55. Also, the mixture being delivered by first delivery mechanism 50 may have a different liquid/granular material ratio than the mixture being delivered by second delivery mechanism 55.

For further context, FIG. 5 illustrates truck 10 with the tailgate or rear cover removed, thus exposing first mixing mechanism 100 and second mixing mechanism 150. Generally speaking, a granular material is contained within bucket 12 of truck 10. Likewise, one or more liquids are contained within first fluid supply tank 30 and second fluid supply tank 40. As described in relation to FIG. 3 above, the liquids are supplied to internal portions of first auger 110 and second auger 112 to accommodate mixing with the granular material. As mentioned above, first mixing mechanism 100 and second mixing mechanism 150 are driven by first and second drive mechanisms 60 and 62 to cause rotation in a desired direction. Additionally, first fluid coupling mechanism 64 and second fluid coupling mechanism 80 exist at one end of first and second augers 110 and 112 to supply the fluid while also allowing rotation. As will be appreciated by those familiar with moving fluid handling components, appropriate bearings and fluid couplings are utilized to allow simultaneous rotation and fluid flow.

Reference may be made throughout this specification to "one embodiment," "an embodiment," "embodiments," "an aspect," or "aspects" meaning that a particular described feature, structure, or characteristic may be included in at least one embodiment of the present invention. Thus, usage of such phrases may refer to more than just one embodiment or aspect. In addition, the described features, structures, or characteristics may be combined in any suitable manner in one or more embodiments or aspects. Furthermore, reference to a single item may mean a single item or a plurality of items, just as reference to a plurality of items may mean a single item. Moreover, use of the term "and" when incorporated into a list is intended to imply that all the elements of the list, a single item of the list, or any combination of items in the list has been contemplated.

One skilled in the relevant art may recognize, after reading this disclosure, that the invention may be practiced without one or more of the specific details, or with other methods, resources, materials, etc. In other instances, well known structures, resources, or operations have not been shown or described in detail merely to avoid obscuring aspects of the various embodiments.

While example embodiments and applications have been illustrated and described, it is to be understood that the invention is not limited to the precise configuration and resources described above. Various modifications, changes, and variations apparent to those skilled in the art, after reading this disclosure, may be made in the arrangement, operation, and details of the methods and systems of the present invention disclosed herein without departing from the scope of the claimed invention.

The various embodiments described above are provided by way of illustration only and should not be construed to limit the claims attached hereto. Those skilled in the art will readily recognize, after reading this disclosure, that various modifications and changes may be made without following the example embodiments and applications illustrated and described herein, and without departing from the true spirit and scope of the following claims.

I claim:

1. A dump truck having a box and mixing mechanism located within the box for combining a liquid and a granular material and delivering the mixture to a desired location at a desired rate, the mixing mechanism comprising:

a first auger for receiving the granular material from the box of the dump truck and moving the granular material along a first predetermined path, the first auger having a first interior section;

a second auger, located in a second portion of the bed, for receiving the granular material from the bed of the dump truck and moving the granular material along a second predetermined path;

a first fluid handling portion coupled to a fluid supply source, the first fluid handling portion comprising a first inlet in fluid communication with the fluid supply source and an outlet in fluid communication with the first interior section of the first auger;

a second fluid handling portion coupled to the fluid supply source, the second fluid handling portion having a second inlet in fluid communication with the fluid supply source and a second outlet in communication with a second interior section of the second auger;

a first discharge hole located at a first predetermined location along the first auger, wherein the first discharge hole is in fluid communication with the first interior section of the first auger wherein operation of the auger and the fluid supply source accommodates the combining of the liquid and the granular material to create a saturated combination thereof within the box prior to its delivery to the desired location; and a second discharge hole located at a second predetermined location along the second auger, wherein the second discharge hole is in fluid communication with the second interior section of the second auger, wherein the first predetermined path and the second predetermined path are in opposite directions, and wherein the first fluid outlet and the second fluid outlet are coupled to a pair of opposite ends of the first auger and the second auger, respectively.

2. A mixing system to cooperate with a sanding truck, wherein the truck carries a granular material within a truck box, and carries a liquid within a liquid handling material, the mixing system comprising:

an auger situated within a receiving trough with the auger and the trough positioned transverse to and substantially across an entire rear width of the truck box, the receiving trough having an open top side adjacent to the truck box thus allowing the granular material carried in the truck box to be gravity fed to the auger along its entire length, wherein the auger comprises a substantially cylindrical main shaft extending substantially the entire width of the truck box and having at least one auger blade extending therefrom, the at least one auger blade configured to move granular material in a predetermined direction along the rear of the truck box when the auger is rotated, the auger further having a central opening within a portion of the substantially cylindrical main shaft, the auger having a first end with a drive opening therein, and a second end having a fluid handling opening therein which is in fluid communication with the central opening, wherein the auger further has a plurality of discharge holes extending through a wall of the main shaft and into the central opening so that fluid is allowed to be discharged from the central opening along the shaft;

a drive mechanism positioned outside the truck box and having a drive shaft removably coupled to the auger drive opening;

a fluid handling system coupling the fluid handling system to the fluid handling opening, such that fluid is provided to the central opening, the fluid handling system being rotatably coupled so that fluid continues to be provided to the central opening when the auger is being rotated, and further having a fluid control so that fluid is provided to the central opening at a controlled rate; and controls to selectively operate the drive mechanism and the fluid handling system, wherein simultaneously providing fluid from the fluid handling system to the to the central opening and operating the drive mechanism will result in fluid to be discharged through the plurality of discharge holes into the receiving trough, and granular material to be moved within the trough, wherein the combined operations produce a slurry along the auger, which can then be delivered to a delivery location.

3. The mixing system of claim 2 wherein the auger has a length and the plurality of discharge holes are located approximately one-third of the length from the first end of the auger.

4. The mixing system of claim 3 wherein the controls are able operate the drive mechanism to rotate the auger at a predetermined rate and wherein the controls further are able to operate the fluid handling system such that fluid is delivered at a predetermined rate.

5. The mixing system of claim 4 wherein the predetermined rate of the auger and predetermined rate of fluid deliver is dependent upon the speed of the vehicle.

6. The mixing system of claim 2 wherein the auger has a length and the central opening extends substantially the entire length of the auger, and the plurality of discharge holes are located across the entire length.

7. The mixing system of claim 2 wherein the plurality of discharge holes are of varied number and size, and wherein the number and size of the plurality of discharge holes are configured to control the amount of fluid discharged from the interior of the auger.

8. The mixing system of claim 2 wherein the auger further comprises a second auger blade configured to move material in a second predetermined direction when the auger is rotated, said second predetermined direction being different than said predetermined direction.

9. The mixing system of claim 8 wherein the discharge holes are positioned adjacent at least a portion of the first auger blade and adjacent at least a portion of the second auger blade.

* * * * *